US006804894B1

(12) United States Patent
Humphries

(10) Patent No.: US 6,804,894 B1
(45) Date of Patent: Oct. 19, 2004

(54) PARALLEL RULE

(76) Inventor: Michael Humphries, 54 Cookham Road, Maidenhead, Berks SL6 7HT (GB)

( * ) Notice: Subject to any disclaimer, the term of this patent is extended or adjusted under 35 U.S.C. 154(b) by 27 days.

(21) Appl. No.: 10/070,499

(22) PCT Filed: Sep. 1, 2000

(86) PCT No.: PCT/GB00/03357

§ 371 (c)(1),
(2), (4) Date: Jun. 17, 2002

(87) PCT Pub. No.: WO01/15913

PCT Pub. Date: Mar. 8, 2001

(30) Foreign Application Priority Data

Sep. 1, 1999 (GB) ..... 9920664

(51) Int. Cl.[7] ..... B43L 13/02
(52) U.S. Cl. ..... 33/454; 33/520; 206/349
(58) Field of Search ..... 33/454, 23.01, 33/25.1–25.3, 32.1, 32.3, 41.1, 452, 666, 669, 492, 562, 563, 566; 206/349, 305, 495

(56) References Cited

U.S. PATENT DOCUMENTS 46,348 A * 2/1865 Gillette ..... 33/454
458,966 A * 9/1891 Calkins ..... 33/454
671,281 A * 4/1901 Kay ..... 33/454
694,185 A * 2/1902 Page ..... 33/454
1,059,797 A * 4/1913 Westbrook ..... 33/454
1,141,483 A * 6/1915 Pfeiffer ..... 33/454
1,213,813 A * 1/1917 Anderson ..... 33/489
1,410,196 A * 3/1922 Krivacs ..... 33/520
1,600,246 A * 9/1926 Rehnzvist ..... 33/454
1,746,537 A * 2/1930 Knechtel ..... 33/454
2,332,100 A * 10/1943 Maclean ..... 33/454
4,272,890 A * 6/1981 Davert ..... 33/562
4,455,750 A * 6/1984 Sturz ..... 33/43
5,193,284 A * 3/1993 Lin ..... 33/449
5,595,295 A * 1/1997 Lin ..... 206/349
6,126,008 A * 10/2000 Cox ..... 206/471

FOREIGN PATENT DOCUMENTS

GB 278502 * 10/1927
GB 2160478 A * 12/1985

* cited by examiner

*Primary Examiner*—Diego Gutierrez
*Assistant Examiner*—Tania Courson
(74) *Attorney, Agent, or Firm*—Michael Y. Epstein

(57) ABSTRACT

A parallel rule is disclosed having two component rules (4, 6) each providing one of two opposed parallel straight edges. A linkage (10) allows relative movement of the rules in a direction orthogonal to the straight edges but prohibits relative movement in a direction parallel to the straight edges. At least one component rule has at least one through hole (12)suitable to receive the point of a pencil.

12 Claims, 6 Drawing Sheets

PARALLEL RULE

This invention relates to parallel rules.

Parallel rules are used for navigation purposes to transfer a direction from one position to another on a chart. Thus a direction may be taken from a compass rose marked on the chart and drawn through a particular position on the chart so as to indicate a course or a transit, for example. When using navigational aids such as sextants or electronic global positioning systems (GPS) it is also necessary to mark a position where a line of latitude intersects a line of longitude, so as to show the craft's position.

Against this background, in accordance with one aspect of the invention, there is provided a parallel rule, comprising two component rules each providing one of two opposed parallel straight edges, and a linkage allowing relative movement of the rules in a direction orthogonal to the straight edges but prohibiting relative movement in a direction parallel to the straight edges, wherein at least one component rule has at least one through hole suitable to receive the point of a pencil.

Such a rule may be used conventionally to mark a line of longitude through a particular easting or westing by placing one straight edge parallel to a line of longitude shown on the chart and expanding the rule until one or other straight edge crosses the particular easting or westing indicated at the edge of the chart. The rule may then be used to mark a northing by placing an edge adjacent the northing scale at the edge of the chart, so that the or a hole is positioned at the required northing, placing the point of a pencil in the hole and expanding the rule to draw a line of latitude on the chart at the required northing. In the alternative the line of longitude could be drawn analogously.

Most preferably, both component rules have through holes in corresponding positions. This allows one hole to be lined up with the appropriate northing and the pencil point to be inserted in the corresponding hole on the other component rule.

In one form the linkage may comprise an intermediate member connected to each component rule by a respective set of three links, two links in each set being pivotally connected to both the intermediate member and the component rule by pivots situated on corners of a variable parallelogram, the other link in each set being pivotally connected to the component rule and both pivotally and slidably connected to the intermediate member for sliding movement together, parallel to the straight edges.

In another form the linkage may comprise two links each pivotally connected to a respective component rule, each pivotally and slidably connected to the other component rule for sliding movement parallel to its straight edge and pivotally connected together between the component rules.

Another aspect of the invention extends to a parallel rule, comprising two component rules each providing one of two opposed parallel straight edges, and a linkage allowing relative movement of the rules in a direction orthogonal to the straight edges but prohibiting relative movement in a direction parallel to the straight edges, the parallel rule being contained by a package, the package being so formed that at least part of the parallel rule is visible therethrough, and so that the component rules may be opened and closed. This allows a prospective purchaser to operate the rule without removing it from its package.

In yet another aspect, the invention provides a parallel rule having two component rules so linked as to constrain them to remain parallel, wherein both component rules are provided on their undersides with a pair of spaced bosses, the bosses being of relatively low friction material, and between the bosses with at least one area of relatively high friction material, the bosses projecting further from the component rules than the high friction areas. As the component rules will be inherently a little flexible, pressing a component rule between the bosses, brings the relatively high friction material into contact with, say, a chart, firmly locating the rule thereon. Releasing the pressure raises the relatively high friction area from the chart so allowing the component rule to glide over the chart on the relatively low friction bosses. One component rule may thus be firmly located while the other is adjusted to its desired position.

Embodiments of the invention will now be described, by way of example, with reference to the accompanying drawings, in which.

Figure 1:
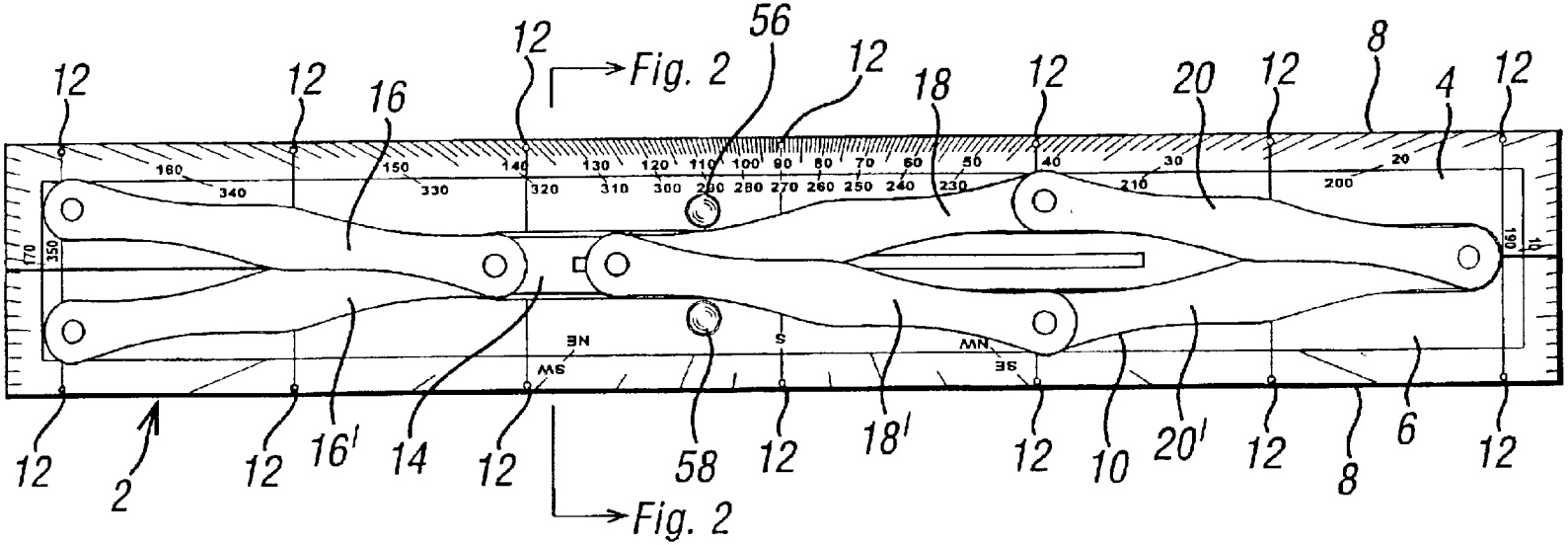
FIG. 1 is a plan view of a parallel rule embodying the invention, when closed.

Referring to the drawings, the parallel rule 2 has two component rules 4 and 6. Each component rule 4 or 6 has a straight bevelled edge 8 positioned so that the straight edges are opposed and on the outside of the parallel rule. The component rules 4 and 6 are connected by a linkage 10 which allows relative movement of the rules in a direction orthogonal to the straight edges but prohibits relative movement in a direction parallel to the straight edges.

In each component rule 4 and 6, behind and proximate each straight edge 8, in the bevel thereof, are conveniently positioned a plurality of through holes 12 suitable to receive the point of a pencil. The holes 12 have a diameter of from 0.5 mm to 3 mm diameter, preferably 2 mm diameter, at the underside of the component rules. The holes are cylindrical for about 1 mm and open out at an included angle of about 60° towards the upper surface of the component rules where their diameters are about 4 mm. The holes 12 are placed in corresponding positions along each straight edge. In use, for example, the straight edge 8 of component rule 4 is aligned with a line of longitude at the edge of a chart so that one of the holes 12 covers a desired mark on the northing scale. A pencil point is put in the corresponding hole 12 in the other component rule 6. Holding the component rule 4 still, the pencil and component rule 6 are moved to mark the chart with what is a line of latitude passing through the desired northing. The rule can be used conventionally or in a similar fashion to mark an intersecting line of longitude passing through a desired easting or westing, so marking a position at the desired latitude and longitude.

Figure 2:
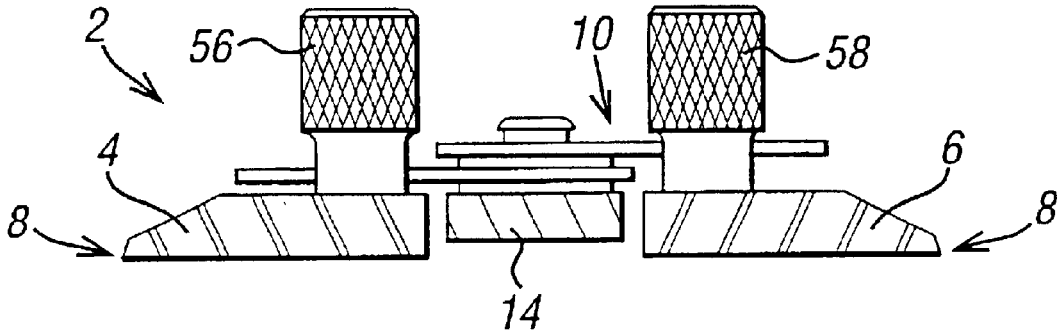
FIG. 2 is a cross sectional view of the rule of FIG. 1.
Figure 3B:
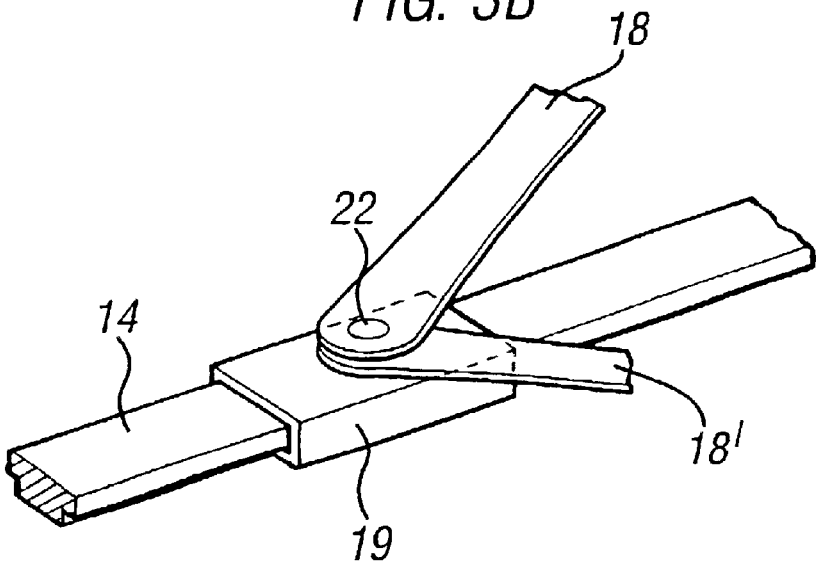
FIG. 3B is a pictorial detail of an alternative arrangement to that of FIG. 1.
Figure 3A:
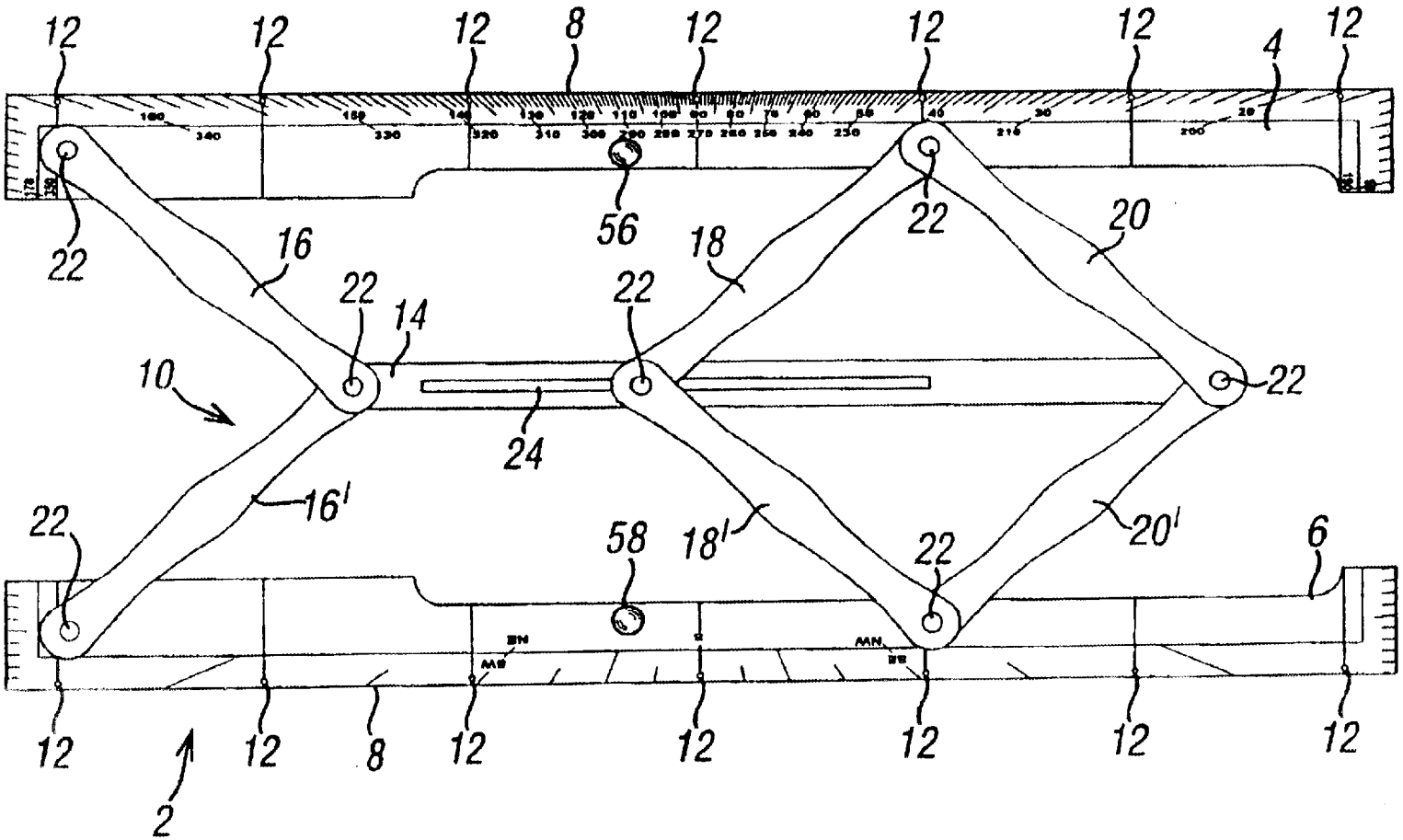
FIG. 3A is a plan view of the rule of FIG. 1 shown in an open position.

The linkage shown in the embodiment of FIGS. 1 to 3 has an intermediate member 14 positioned between the component rules 4 and 6. Each component rule is connected to the intermediate member 14 by a set of three linkages 16, 18 and 20 or 16', 18' and 20'. The linkages are connected to the component rule 4 or 6 and the intermediate member 14, by pivot pins 22. The pivot pins connecting the linkages 16 and 20 or 16' and 20' are arranged at the comers of a respective parallelogram so that the distance between the pivot pins of each link is the same as the other in the set. Links 16, 16', 20 and 20' are the same length as each other. Links 18 and 18' are the same length as each other and in this example as the links 16, 16', 20 and 20'. The pivot pins 22 are located in the same relative positions on the component rules 4 and 6. The pivot pins for the links 16, 16', 20 and 20' are located the same distance apart on the intermediate member 14, as on the component rules 4 and 6. Ignoring the links 18, 18' the component rules 4 and 6 can move relative to the intermediate member 14 whilst retaining the straight edges 8 parallel. The links 18 and 18' are connected to the intermediate member 14 by a common pivot pin 22 which is itself slidable in a slot 24, parallel with the straight edges, in the intermediate member 14. Such constraint of the links 18 and 18' to move together prevents the component rules 4 and 6 moving relatively in a longitudinal direction parallel to the straight edges 8 and confines relative movement to a direction normal to the straight edges.

In an alternative arrangement, the links 18 and 18' are pivotally attached to a traveller 19 shown in FIG. 3B. The traveller receives the intermediate member 14 along which it is arranged to slide.

Figure 4:
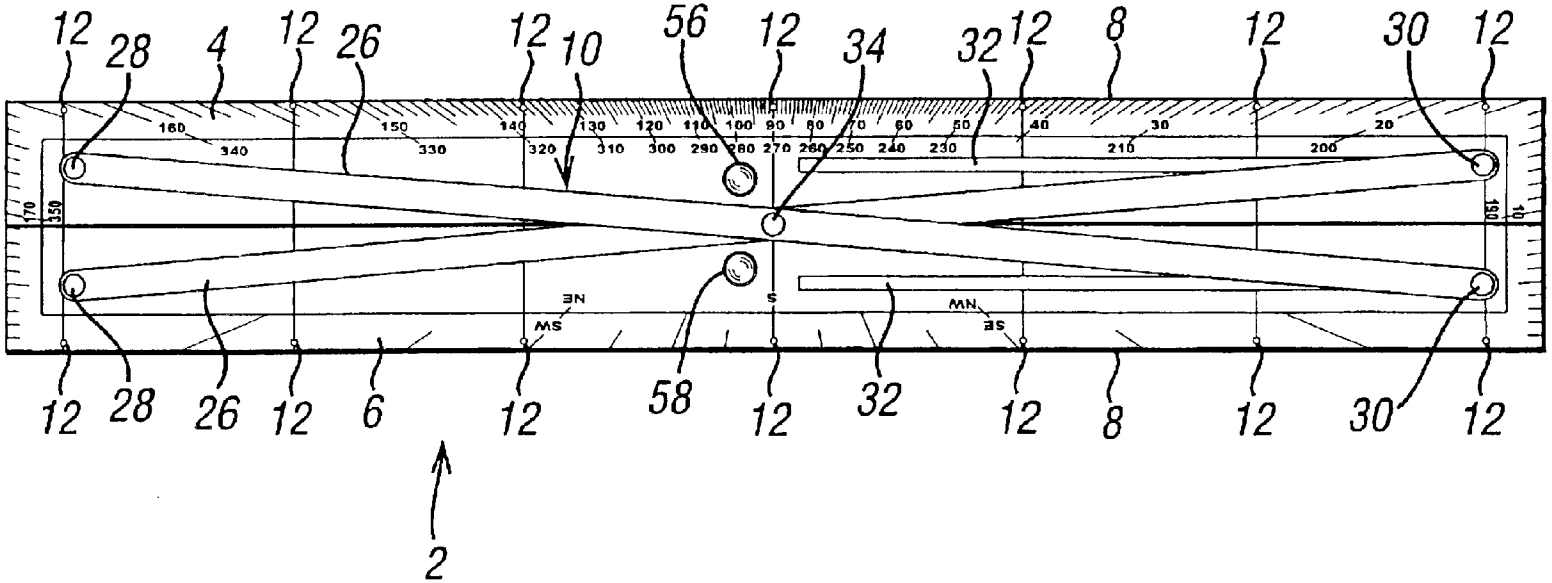
FIG. 4 is a plan view of another parallel rule embodying the invention, shown in its closed position.
Figure 5:
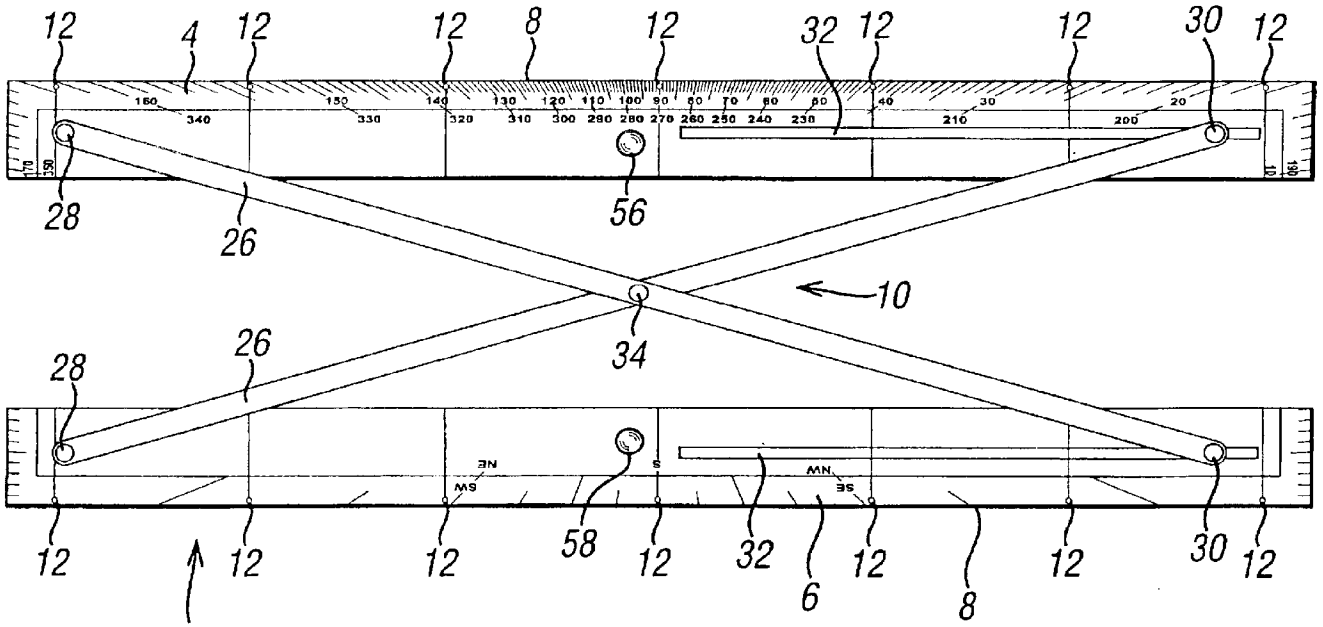
FIG. 5 shows the parallel rule of FIG. 4 in an open position.
Figure 7:
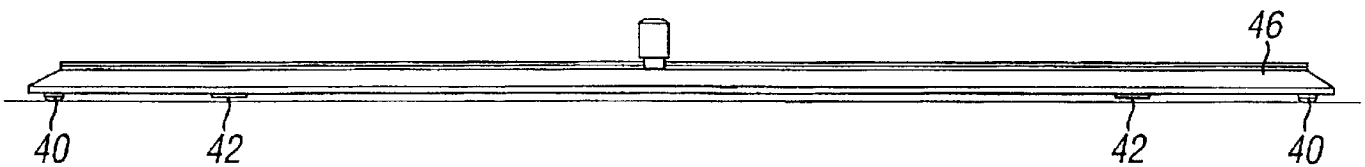
FIG. 7 is a side view of the parallel rules of FIGS. 1 to 5.

Another linkage which achieves this effect is illustrated in FIG. 4. Here the component rules 4 and 6 are connected by two links 26. Each link 26 is pivotally connected to a respective component rule 4 or 6 by one non-sliding pivot pin at 28. Each link is connected to the other respective component rule by another pivot pin 30 which is slidable in a slot 32 in the component rule. Each slot 32 is parallel with the relevant straight edge 8. The links 26 are joined between their ends by a further pivot pin 34 such that the distances between the pivot pin 34 and the pins 28 and are the same as each other. The pivot pins 28 and the slots 32 are in the same relative positions on both component rules 4 and 6.

In order to facilitate the operation described above, each component rule 4 and 6 is provided with bosses 40 of relatively low friction material and at least one area 42 of relatively high friction material. The bosses 40 may be formed integrally of a plastics material, e.g. acrylic or polycarbonate, with the component rules 4 and 6. The bosses are spaced, being placed towards the ends of the component rules. The relatively high friction areas 42 may be provided, for example by a layer of silicone rubber. The bosses 40 project further from the undersides of the component rules than do the high friction areas. In use, to hold a component rule still, as described above, the component rule is pressed between its bosses so as to flex the component rule to bring the high friction areas to bear against the chart. Placing a pencil point in one of the holes 12 to draw the other component rule across the chart, as described above, does not flex the component rule, so allowing it to glide across the chart on the bosses 40.

Figure 6:
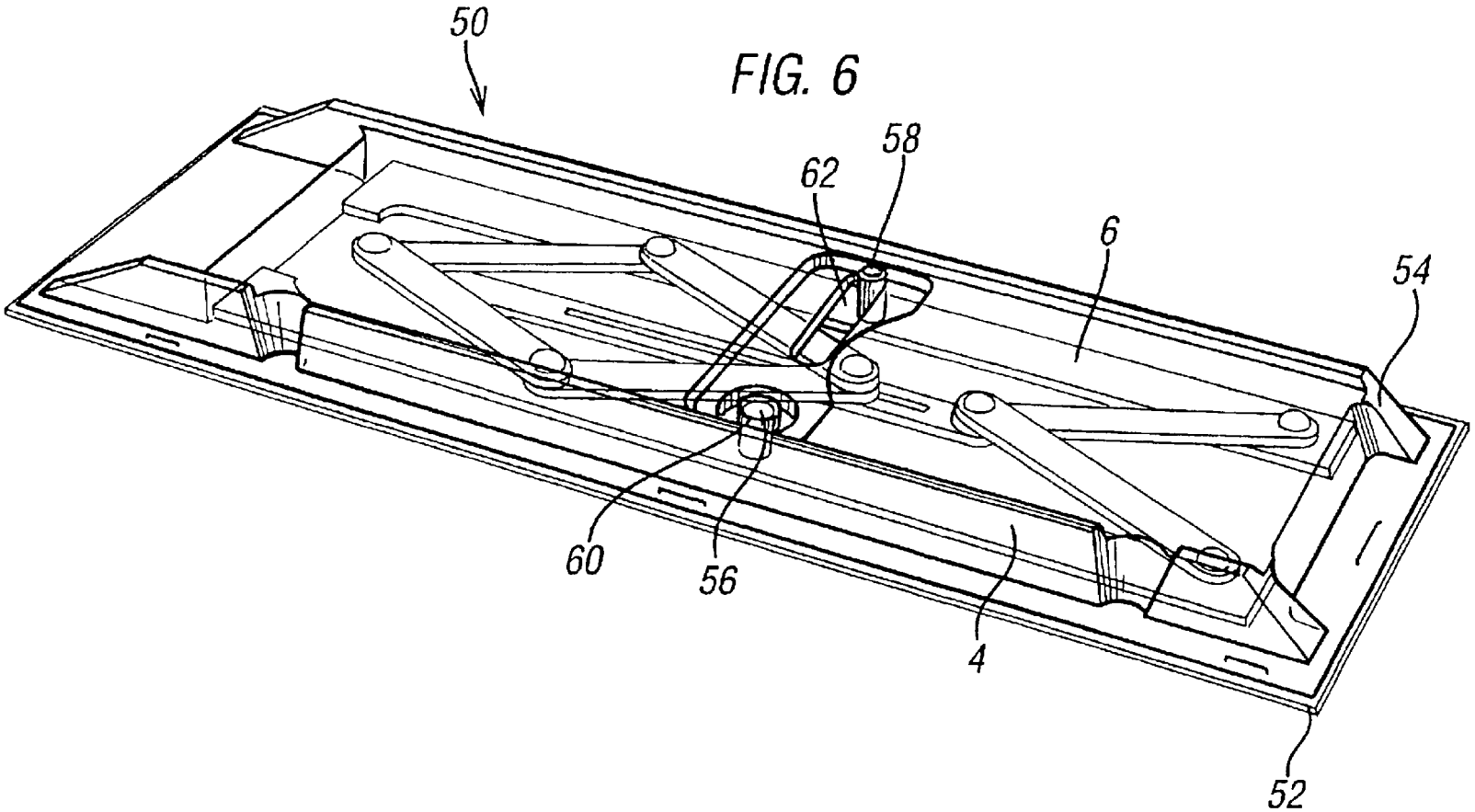
FIG. 6 is a pictorial view of the rule of FIG. 1 in a package.

In order to allow a prospective purchaser to see the operation of the parallel rule without the need to unpack it, a package 50 is provided as illustrate in FIG. 6. The package has a card base 52 and a transparent cover 54. The base may be printed with a section of a real or fictitious chart. The package is wide enough to allow the component rules 4 and 6 to be parted and closed. The component rule 4 is provided with a handle 56. Similarly, the component rule 6 is provided with a handle 58. The handles 56 and 58 facilitate use of the rule as described on a chart. In the package, the handle 56 extends into a closed recess 60 to restrain it from moving. The handle 58 extends through an opening 62 allowing it to be accessed from outside the cover 54 so as to separate or close the component rules while the parallel rule remains in the package.

What is claimed is:

1. A parallel rule comprising two component rules each providing one of two opposed parallel straight edges, and a linkage allowing relative movement of the rules in a direction orthogonal to the straight edges but prohibiting relative movement in a direction parallel to the straight edges, wherein at least one component rule has at least one through hole suitable to receive the point of a pencil so as to make a line of latitude or longitude on a chart and the other of said component rules has a through hole in corresponding position to said at least one through hole of said one component rule.

2. A parallel rule as claimed in claim 1, wherein said correspondingly positioned through holes are disposed along a line in fixed orthogonal relationship with said straight edges in all positions of said component rules relative to one another.

3. A parallel rule as claimed in claim 2, wherein both component rules have a plurality of through holes spaced along the lengths thereof in corresponding positions and with pairs of said holes being in fixed orthogonal alignment with said straight edges.

4. A parallel rule as darned in claim 1, the linkage comprises an intermediate member connected to each component rule by a respective set of three links, two links in each set being pivotally connected to both the intermediate member and the component rule by pivots situated on corners of a variable parallelogram, the other link in each set being pivotally connected to the component rule and both pivotally and slidably connected to the intermediate member for sliding movement together, parallel to the straight edges.

5. A parallel rule as claimed in claim 1, wherein the linkage comprises two links each pivotally connected to a respective component rule, each pivotally and slidably connected to the other component rule for sliding movement parallel to its straight edge and pivotally connected together between the component rules.

6. A parallel rule as claimed in claim 1 contained by a package, the package being so formed that at least part of the parallel rule is viable therethrough, and so that the component rules may be opened and closed.

7. A parallel rule as claimed in claim 6, wherein the package has an opening through which one of the component rules may be accessed, to open and close the component rules, whilst retaining the parallel rule in the package.

8. A parallel rule as claimed in claim 7, wherein each component rule is provided with a handle, and wherein the package is so formed as to restrain movement of one handle, the other handle projecting through the opening.

9. A parallel rule as in claim 6, wherein the package is at least partly transparent.

10. A parallel rule as claimed in claim 1, wherein both component rules are provided on their undersides with a pair of spaced bosses with at least one area of relatively high friction material, the bosses projecting further from the component rules than the high friction areas.

11. A method of making a line of latitude or longitude on a chart using a parallel rule comprising two component rules each providing one of two opposed parallel straight edges, and a linkage allowing relative movement of the rules in a direction orthogonal to the straight edges but prohibiting relative movement in a direction parallel to the straight edges, wherein a first of said component rules has at least one through hole suitable to receive the point of a pencil so as to make a line on a chart, the method comprising aligning the straight edge of the second component rule with a first line of longitude or latitude at an edge of a chart, placing a pencil point in the through hole in said first component rule and in contact with said chart, and; while holding said second component rule still, moving the first component rule and the pencil point laterally away from said second component rule for making a second line on said chart orthogonal to said first line.

12. A method according to claim 11, wherein both said component rules have through holes in corresponding positions along the lengths of the rules and with pairs of correspondingly positioned holes being disposed along a line orthogonal to said straight edges; the method further including aligning the straight edge of said second component rule with said first line at a chart edge with a first hole in said second component rule covering a selected mark on said chart and, upon said movement of said first component rule laterally away from said second component rule, making said second line on said chart along a direction intersecting said selected mark by means of a pencil point placed in that hole in said first component rule paired with said first hole in said second component rule.

* * * * *